US005680856A

United States Patent [19]

van Dijk

[11] Patent Number: 5,680,856

[45] Date of Patent: Oct. 28, 1997

[54] DISCHARGE STRUCTURE FOR CLOSED GAS APPLIANCES

[75] Inventor: Floris van Dijk, Doesburg, Netherlands

[73] Assignee: Ubbink Nederland B.V., Doesburg, Netherlands

[21] Appl. No.: 344,113

[22] Filed: Nov. 23, 1994

[30] Foreign Application Priority Data

Nov. 24, 1993 [NL] Netherlands ..... 9302032
Oct. 31, 1994 [EP] European Pat. Off. ..... 94203152

[51] Int. Cl.[6] ..... F24C 3/00

[52] U.S. Cl. ..... 126/85 B; 126/307 R; 126/312; 126/77; 126/80

[58] Field of Search ..... 126/85 B, 307 R, 126/312, 77, 80, 317

[56] References Cited

U.S. PATENT DOCUMENTS

| | | | |
|---|---|---|---|
| 4,466,340 | 8/1984 | Briner . | |
| 4,502,370 | 3/1985 | Baileys et al. | 126/307 R X |
| 4,608,963 | 9/1986 | Townsend . | |

FOREIGN PATENT DOCUMENTS

| | | | |
|---|---|---|---|
| 0491444 | 6/1992 | European Pat. Off. . | |
| 0552691 | 7/1993 | European Pat. Off. . | |
| 2582782 | 12/1986 | France | 126/307 R |
| 8801181 | 12/1989 | Netherlands . | |
| 287335 | 3/1928 | United Kingdom . | |
| 1320943 | 6/1973 | United Kingdom . | |

*Primary Examiner*—Larry Jones
*Attorney, Agent, or Firm*—Ladas & Parry

[57] ABSTRACT

Modular discharge structure for closed gas appliances having an inner end and an outer end, comprising: an outer tubular casing; an inner gas exhaust pipe, being placed inside the casing to define an annular supply line for combustion air therewith; a combustion air supply hood, forming a connection between the outside air and the annular supply line, and a combustion gas exhaust hood, forming a connection between the outside air and the gas exhaust pipe, and further comprising retaining means for axially keeping together, in series and in a mechanical and releasable manner, the casing, the combustion gas exhaust hood and the combustion air supply hood on the gas exhaust pipe.

28 Claims, 3 Drawing Sheets

59''
51''
59''
52
53
59
51''
21
22
58
51'
50
54
59'
1C
51'
57
56
55
57
47
46
48
45
47
45
40
43
43
1B
32
33
31
44
41
42
37
35
34
38
36
30a
74
75
90'
60
A
71
B
73
72
3
30
1
30a
20
39''
39'
39'
90
10
30b
74
75
1A
71
70
73
72
80
81
20
54
56
55
57
47
46
48

32
43
31
44
35
34
42

DISCHARGE STRUCTURE FOR CLOSED GAS APPLIANCES

BACKGROUND OF THE INVENTION

The invention relates to a discharge structure for closed gas appliances. Such discharge structures form the main component of a roof terminal or wall terminal for, for instance, heating boilers and comprise a line for the supply of combustion air and a line for the exhaust of combustion gasses. The discharge structure then further comprises a supply means for combustion air, such as a supply hood, forming the connection between the outside air and the supply line for combustion air, and a flow-promoting exhaust means for combustion gasses, such as a draught hood, forming the connection between the combustion gas exhaust line and the outside air. The exhaust means is situated at a greater distance from the space in which the gas appliance is located than the supply means, that is to say, in a vertical arrangement of the discharge structure, above the supply means.

Such a discharge structure is also referred to as a wall or roof terminal structure. In this application, the inner end is considered as the end which has to be connected to the combustion air supply and the combustion gas exhaust of the gas appliance itself, whether through the medium of a manifold or not, with which manifold or branch pipe the combustion gas exhaust line and the combustion air supply line in the discharge structure, situated concentrically relative to each other, are transformed into parallel lines.

Discharge structures are often completely adapted to the brand and type of the gas appliance onto which they are to be fitted or to a certain group of gas appliances with a defined working area or working range width. The discharge structures are supplied in new building and renovation projects in the composition and with the dimensions in which they are about suitable for mounting in the work. The various components are herein connected to each other in a usually permanent manner in the factory, for instance by being welded, riveted or glued, in a manner which is usually very labour-intensive.

Because the various standards may prescribe a minimum height above the roof for the combustion gas exhaust means and the exact position of the gas appliance below the roof, it can be necessary that the discharge structure is given a certain surplus length in order to, in the absence of simple possibilities far adaptation, in the case of deviations in measurement in the work, yet be able to fall within these standard values or fitting measures.

It is also a drawback that the selection of materials for the various components of the discharge structure will be subject to restrictions, due to the manner in which the components are connected to each other, for instance when a threaded connection is used.

Another drawback to the known discharge structure is that alterations in the discharge structure after a period of use, necessary for for instance replacement of components thereof, is difficult and usually impossible due to the way in which those discharge structures have been assembled. Consequently, the entire discharge structure will often need to be replaced.

SUMMARY OF THE INVENTION

It is the object or the invention to provide a discharge structure for closed gas appliances, which improves on the above. This object is realized with the discharge structure according to the invention, having an inner end and an outer end, comprising: an outer tubular casing having an outer end and an inner end; an inner pipe for the exhaust of combustion gasses having an outer end and an inner end, the inner pipe being placed inside the casing to define an annular supply line for combustion air therewith; a combustion air supply means, forming connection between the ambient air and the annular supply line, near the outer end thereof; a combustion gas exhaust means, forming a connection between the ambient air and the gas exhaust pipe, near the outer end thereof, and which is placed further from the inner end of the discharge structure than the combustion air supply means; and further comprising retaining means for axially keeping together in a mechanical manner the casing, the gas exhaust pipe, the combustion gas exhaust means and the combustion air supply means, the gas exhaust pipe being provided on its outer end with retaining means, which are formed as first abutment means.

By employing retaining means such as or instance abutment means for keeping together said components in a mechanical manner, no species tools are required, except for instance a screwdriver, for assembling the discharge structure, as a consequence of which this could be done at sales locations and even at the site by junior or unskilled persons. Moreover, this leads to a greater freedom of choice of materials for the various components, because for instance the suitability of the various components for being welded together need no longer be taken into account. Because the discharge structure can be assembled at sales locations or at the site, the gas exhaust pipe and the casing can also be adapted to the dimensions at the site. This can be the case both in new buildings or renovation and in replacement after a period of use.

Herein, a modular assembly has been rendered possible, wherein a number of sizes of each component are kept in stock in the factory, at the wholesalers or at the sales location, and wherein the discharge structure can simply be assembled on order at that location, one step prior to the delivery to the installer or contractor, adapted to his regiments.

The modular assembly also renders it possible to cater for specific requirements and wishes for discharge structures confined to specific gas appliances.

The retaining means preferably comprise an adjustable retaining portion on the inner end and a retaining portion on the outer end of the inner pipe means, which between them stay, in series, the combustion gas exhaust means, the combustion air supply means and the casing. It is herein furthermore preferred that the first abutment means are arranged for detaining the combustion gas exhaust means in outward direction, the combustion gas exhaust means being provided with second abutment means for detaining the combustion air supply means in outward direction, the combustion air supply means being provided with third abutment means for detaining the casing in outward direction, and the discharge structure further comprising inner abutment means, which can be stayed at a chosen location on the gas exhaust pipe and which form the adjustable retaining portion for detaining the casing in inward direction. Consequently, assembling the discharge structure according to the invention is very simple. The assembler or installer takes the gas exhaust pipe and then or hood, the combustion air supply means or hood, an insulating sleeve and one casing from the inner end of the gas exhaust pipe, until the combustion gas exhaust means is detained at the outer end of the gas exhaust pipe by the retaining portion. A returning movement of these components is thereafter prevented by the adjustable retaining portion, also referred to as the inner abutment means. Prior to this, the assembler or installer has been able to make the gas exhaust pipe to size by means of for instance a saw. The discharge structure is then ready for arrangement in the work en connection to the gas appliance. Because the important measurements have been taken earlier and have been worked into the discharge structure, this installment can be carried out smoothly, so that the workspeed can be increased.

Depending on the type of combustion gas exhaust means it may be necesary, in order to render the above-mentioned sliding action possible, to let it consists of two parts, preferably as comprising a hood, consisting of a first part, slidable over the gas exhaust pike, from the inside towards the outside, upto against the first abutment means and preferably consisting of a second part, mountable on the first part and comprising a shield member which can be placed in front of the external discharge of the gas exhaust pipe.

In a simple embodiment, the inner abutment means comprises a retaining part and a clamping part, which are consecutively slidable from the inner end onto the gas exhaust pipe, the clamping part being provided with securing means, such as a sharp-tipped screw, for securing on the gas exhaust pipe against sliding back. Preferably, the clamping part comprises a ring which is slidable onto the gas exhaust pipe.

The combustion gas exhaust means can be formed by an outer end of the inner pipe itself, but is preferably formed by a combustion gas exhaust hood, especially in vertical discharge structures. In the first case, in a preferred embodiment of the discharge structure according to the invention, the combustion gas exhaust means is integrally formed onto the gas exhaust pipe and the first abutment means is arranged to detain the combustion air supply means in outward direction, the combustion air supply means being provided with second abutment means to detain the casing in outward direction and the discharge structure further comprising inner abutment means, which can be secured at a chosen location on the gas exhaust pipe and which form the adjustable retaining portion for detaining the casing in inward direction.

From the point of view of gas flow, it has been found to be advantageous if the combustion gas exhaust hood, if present, especially the wind shield band thereof, is formed taperingly from the inner end towards the outer end. It is even more preferred herein if the hood is formed taperingly on both the internal and the external side thereof. This not only achieves a flow-promoting guidance for the combustion gasses supplied through the inner pipe and escaping via the combustion hood, but a draught-promoting effect is also achieved when outside air strikes the tapered outer surface of the gas exhaust hood. An additional advantage in that, if the gas exhaust hood is realized in two parts, that is to say with a detachable cover plate, the remaining portions of the exhaust hood can be nested and can moreover be easily formed by means of injection-moulding.

In the case of gas appliances of the type having an improved efficiency, i.e. Dutch test requirements require the arrangement of an insulating sleeve or casing around the gas exhaust pipe to prevent the forming of condensate, which cannot He discharged from the boiler, and/or to prevent heating of combustion air. In this case, it is advantageous if an insulating sleeve is placed in the annular line, which reaches to at least near the outer end of the combustion air supply means and is detained directly or indirectly on its outer end in outward direction by the first abutment means, the gas exhaust pipe or the combustion gas exhaust means and which is detained on the inner end in inward direction by the inner abutment means.

The first and the inner abutment means are preferably executed such that they are not only active in axial direction, but also in radial direction, in order to stay the various components, which have to be kept concentrically relative to each other, in radial direction relative to each other.

In the discharge structure according to the invention, there is a free choice of material, except for requirements relating to corrosion resistance, fire resistance and sun light resistance. Consequently, the components can be manufactured from a synthetic material, with the possible exception perhaps, on account of the temperatures, of the inner pipe means. This is especially advantageous for a discharge structure because thus provisions, which are complicated but advantageous from the point of view of flow technique, become possible in an inexpensive way. This especially holds true for the combustion gas exhaust means and the combustion air supply means and the casing at the location of the air supply means. The use of a synthetic material, moreover, offers possibilities regarding the use of colours, without a supplementary surface treatment, as a consequence of which the discharge structure, if so desired, will be able to have a less obvious presence or, contrary to this, can be given a contrasting colour.

The application further relates to a discharge structure for roof or wall terminals, as described in the preamble, wherein the combustion air supply means forms a main passage for combustion air, extending between the outside air and the annular line, and is also provided with a venting passage, which forms a direct connection for combustion air between the main passage and the outside air.

If the combustion air supply means is embodied as a supply hood, reaching on its inner end over the outer end of the casing and defining an entrance of the main passage therewith, then preferably the venting passage is provided in the outer end Or the hood, in particular in the shape of one or more holes. Advantageous embodiments hereof are described in the accompanying claims 20–22. Too high a pressure built-up inside the air supply means, in particular the air supply hood, which could form a disturbance for the burner or, as a consequence of air streams caused thereby, for the efficiency of the appliance due to losses during standstill, are hereby controlled.

The invention furthermore relates to a manifold suitable for a discharge structure, as for instance described above, the manifold comprising an upper part and a lower part, which are fastened onto each other at the location of a joint face which is substantially transverse to a gas exhaust pipe. This renders it possible to manufacture the manifold in a simple way by injection-moulding, that is to say in two parts, while moreover undesirable leakage points are avoided because the partition in the manifold is not, as is otherwise usual, present at the location of the connecting locations with the discharge structure and the connecting pipes for the supply of air and discharge of combustion gas to and from the gas appliance.

It is herein preferred that both parts are provided at the location of the joint face with cooperating snap connection means, preferably forming a labyrinth, so that special sealing means need not be necessary.

According to a further development according to the invention, the manifold is provided on one end, but preferably the outer end, with two raised edges situated concentrically relative to each other, which raised edges define an annular slot between them, opening to the end concerned, the radially inwardly situated edge being situated near the outer wall of the pipe connecting thereto, in particular the casing, the manifold further comprising a sealing ring, provided with a radially inwardly projecting roundgoing flange lip and an essentially roundgoing body transverse to the ring, said body fitting into the annular slot so as to stay the sealing ring therein. Such an annular slot, directed in the open-close direction of an injection moulding die, offers the opportunity for a simple and quick mounting of the said sealing ring.

The sealing ring is preferably provided in its body with integrally formed, sidewards projections, which can cooperate with the slot wails so as to stay the body therein.

BRIEF DESCRIPTION OF THE FIGURES

The invention will now be explained by means of a discussion of a number of embodiments of a discharge structure according to the invention, shown in the accompanying drawings. The following is shown in.

DESCRIPTION OF EMBODIMENTS

Figures 1, 1A, 1B, 1C:
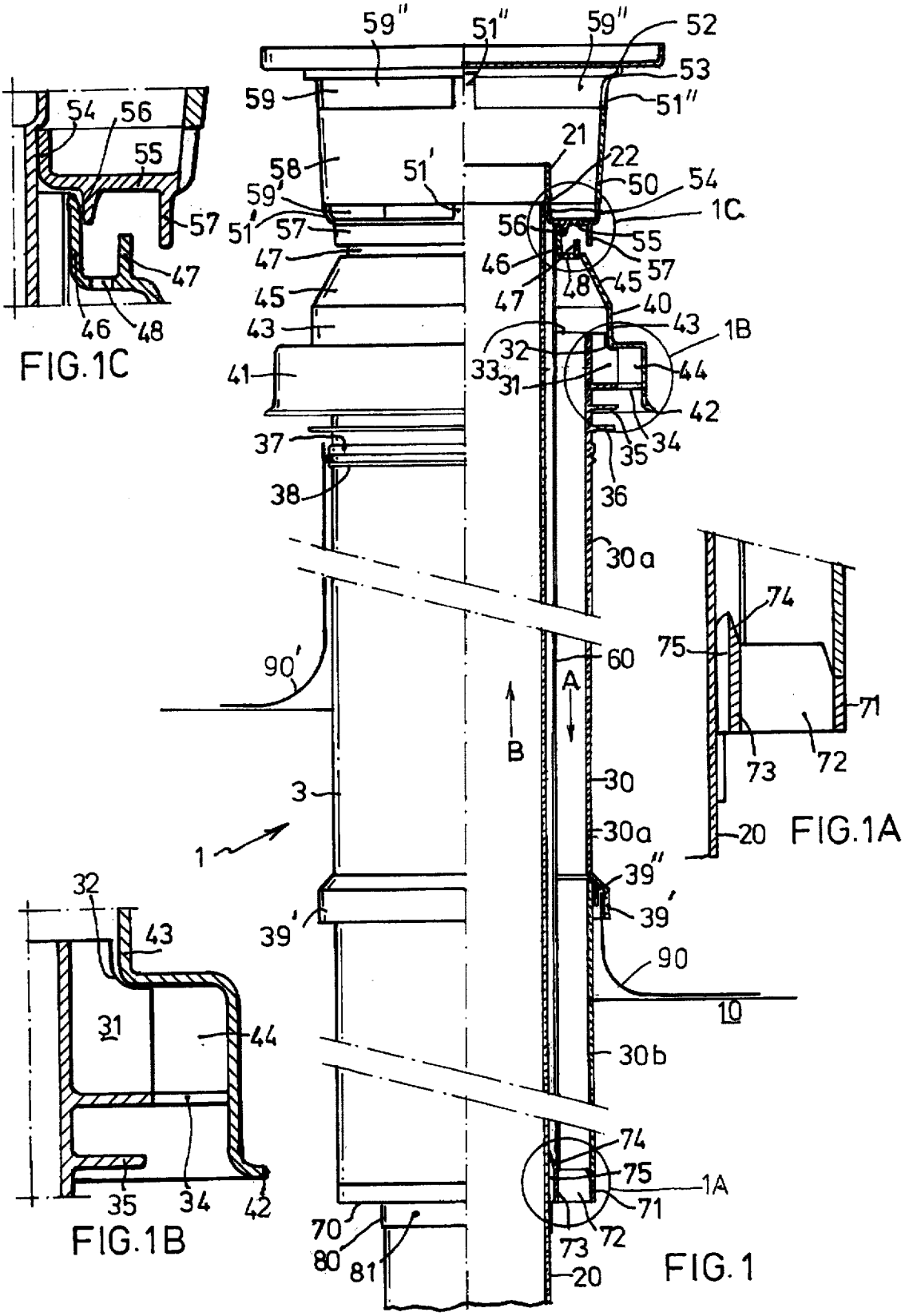
FIG. 1 a vertical embodiment or the discharge structure according to the invention, a view on the discharge structure being shown on the left hand side and a cross section of the discharge structure doing shown in the right hand side, FIG. 1A a detail on the bottom side of the discharge structure of FIG. 1, FIG. 1B a detail of hair supply hood of the discharge structure of FIG. 1, FIG. 1C a detail of the air supply hood / draught hood of the discharge structure of FIG. 1, FIG. 2 an alternative embodiment of the discharge structure according to the invention.

The discharge structure 1 of FIG. 1 comprises an inner pipe 20 for discharge of combustion gasses in the direction B, towards the outside, an outer pipe 30, for the supply of combustion air in the direction A, from the outside to a boiler (not shown), an air supply hood 40, a combustion gas exhaust hood 50, an insulating sleeve 60, a retaining ring 70 and a clasping ring 80. The discharge structure can either connect directly with its bottom end to the connecting pieces of the boiler, or to concentric line components connected thereto, or can be connected thereto via a so-called manifold and parallel line components. If the circumstances render it possible, it could be considered to include the parts 70 and 80 into the manifold. The inner pipe 20 passes on its outer end, in this case its upper end, via an annular shoulder 22 into a portion having a larger diameter 21. What is especially important here is the shoulder 22, of which the function will be further discussed below. In the drawing, the outer pipe 30 consists of two parts **30*a* and 30*b*. The pipe part 30*a* herein has a length, corresponding to the regulations concerned. The outer pipe 30*b* can simply be adapted in length to the situation in situ. At its bottom side, pipe part 30*a* is provided with a storm collar 39', and also with a retaining ring 39" situated therein, and active in radial direction for keeping the pipe part 30*b* in position relative to pipe part 30*a*. The storm collar 39' furthermore serves to accommodate the upper end of a so-called adhering plate (i.e. flat roof adaptor for bitumen) 90, for sealing the passage through the roof 10. The adhering plate 90 sealingly connects to the roof covering (not shown). At its upper end, the pipe part 30*a* is provided with a number of radial partitions 31 distributed in circumferential direction, which partitions are provided on their outer upper end with a recess 32. Below these small partitions 31, immediately adjacent thereto, are situated radially projecting spacing fingers 34 which are also evenly distributed over the circumference. Furthermore, below these, there are located two roundgoing pressure increasing rings 35 and 36, and below these there are located roundgoing fastening ribs 37 and 38. These ribs can receive a sealing ring between them, in case an adhering plate 90'** is placed at that location. Such an arrangement, in which the discharge structure extends less far above the roof than is shown on the right hand side of FIG. 1, is admissible in some countries.

At its bottom side, the air supply hood 40 is provided with an annular supply opening for ambient air and starts, considered from the bottom upwards, with an edge 42, a first essentially cylindrical portion 41, which passes via a first radial step into a second, essentially cylindrical portion 43 having a reduced diameter, which portion 43 passes via a tapering portion 45 into a second, essentially radial step, which finally ends in a third essentially cylindrical portion 46. A raised roundgoing collar 47 is situated radially outside the portion 46, while between both parts 46 and 47, in the second radial step, a number of air passages 48 are present, evenly distributed in circumferential direction, which air passages form a short circuit between the passage from the outside to the annular line and the ambient air so as to vent the surplus of air.

The gas exhaust hood 50 comprises an annular bottom portion 55, provided on its radial inner side with a raised ring 54, situated more outwardly with a depending ring or series of projections 56 and even more outwardly with a downwardly extending ring 57. Above the annular bottom 55, a roundgoing, slightly tapering screen 58 or wind shield band is situated, connected to the bottom 55 by means of raised portions 51' and to the roundgoing lid support 53 via legs 51". In this way, draught openings 59' are left clear below the screen 58 and exhaust holes 59" are left clear above the screen 58. The lid 52 is situated on top of the exhaust hood, by which means it is prevented that rains comes in or that objects fall into the exhaust hood and that otherwise the functioning of the exhaust hood is improved by deflecting fall wind.

The collar 47, the annular bottom portion 55 and the ring 57 form a labyrinth-shaped screen for the air openings 48, so that rain can be prevented from entering and a gust of wind can also not impair the air pressure surplus-reducing action of the openings 48.

An insulating sleeve 60 is placed around the inner pipe 20, which insulating sleeve extends from the lower end of the outer pipe 30 up to the gas exhaust hood.

Assembling the discharge structure 1 is done as follows. The pipe 20 is kept upside down, with the widened portion 21 pointing downwards. If necessary, thin widened portion 21 can be placed on a raising having a fitting, comparable diameter. Then, first, the gas exhaust hood 50 is slid on the inner end or lower end, now the upper end, of the inner pipe, until the ring 54 touches the shoulder 22. The exhaust hood is hereby detained against further displacement in sliding direction and moreover centered relative to the inner pipe. Subsequently, the air supply hood 40 is made to slide downwards over the inner pipe, until the axial annular portion 46 touches the annular bottom 55 of the exhaust hood 50. The portion 46 is herein retained in radial direction by the ring or series of cams 56. In the case shown here, in which an insulating sleeve 60 is present, the diameter of the portion 46 of the supply hood 40 is chosen such, that radial space is present for the insulating sleeve. The next step is that the insulating sleeve 60 is slid over the inner pipe until what is then the bottom extremity, also touches the annular bottom 55 of the exhaust hood, and is centered at that location by the portion 46 of the supply hood 40. Next, the outer pipe 30 is lowered over the inner pipe 20 and the insulating sleeve 60, until the upper edges of the recesses 32 of the small partitions 31 touch the inner surface of the area of the wall of the supply hood 40 near the transition from the cylindrical portion 43 and the first step thereof. Consequently, the outer pipe is detained both in axial direction and in radial direction relative to the preceding parts. The small partitions 31 between them create air flow openings. The fingers 34 also contribute to the centering of the parts 30 and 40 relative to each other and also leave clear flow openings. Air can therefore flow in from the outside, past the edge 42, between the fingers 34 through the space 44 and between the small partitions 31, to the inside so as to enter the annular apace between the outer pipe 30 and the insulating sleeve 60 and to flow in the direction A.

When the outer pipe has been installed, the retaining ring 70 is installed, which retaining ring is provided with two rings 71 and 73, placed concentrically relative to each other and being connected to each other by means of small radial partitions 72. These small radial partitions between them leave clear sufficient flow openings for the combustion air supplied to a manifold, not shown in more detail, which is connected to the inner end of the annular space in an almost sealing manner, and which connects on its other side to the air supply and the gas exhaust of the gas appliance. On its upper end, seen in FIG. 1, the inner ring 73 is provided with a locating edge 74, with which the insulating sleeve 60 is positioned relative to the inner pipe 20. The ring 71 is formed such that it connects smoothly onto the outer pipe **30*b*. Finally, a ring 80, closely fitting onto the inner pipe 20, is slid on until it abuts retaining ring 70 and then secured by means of tipped screws 81 on the inner pipe 20. The result then is that the exhaust hood 50, the supply hood 40, the outer pipe 30 and the insulating sleeve 60 are retained between the shoulder 22 and the clamping ring 80. After this has happened, the discharge structure is turned over and the lid 52 is secured onto the exhaust hood 50**. This can for instance be done by means of screws or by means of a snap connection.

The various components of the discharge structure according to the invention can be manufactured from aluminium, highgrade or not, stainless steel, steel, galvanized according to the Sendzimir process. Due to the chosen method of composition, however, most components can be made of a synthetic material. This applies to the gas exhaust hood (PBT), the air supply hood, which is not subjected to high temperatures and can for instance be made from PVC, the part of the outer pipe **30*a* projecting above the roof, and the part of the outer pipe 30*b*** below the roof, which can both also be manufactured from synthetic material, such as PVC or PE, the retaining ring and the clamping ring.

Figure 2A:
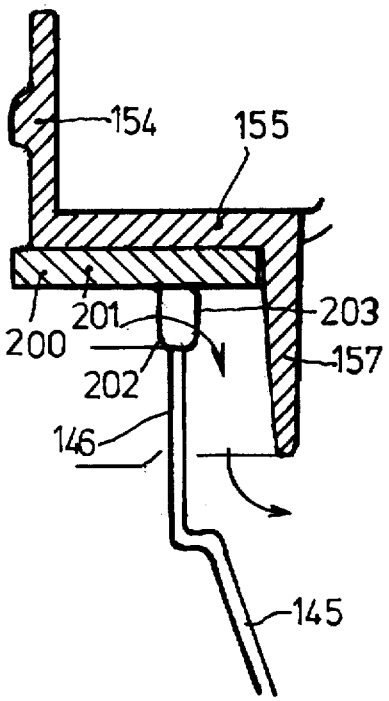
FIG. 2A a detail of the connection of the air supply hood and the combustion gas exhaust hood of the discharge structure of FIG. 2.
Figure 2:
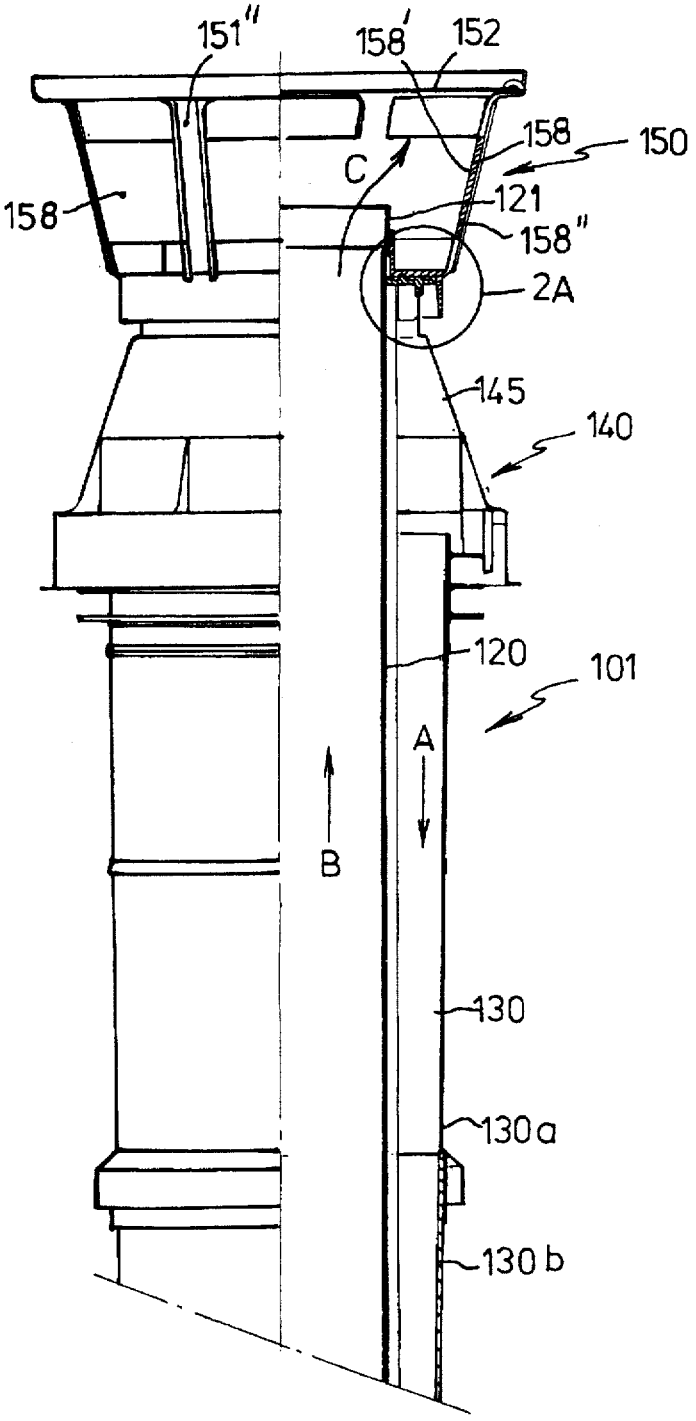

FIG. 2 shows an alternative discharge structure 101, built up substantially from an inner pipe 120, a casing 130 an air supply hood 140, a combustion gas exhaust hood 150. The discharge structure 101 is essentially similar to the discharge structure shown in FIG. 1. The combustion gas exhaust hood 150 is however more tapering than the combustion gas exhaust hood 50. Compared to usual circular-cylindrical combustion gas exhaust hoods, a calm flow pattern is obtained, while maintaining the guiding and wind screening function. Moreover, the combustion gas exhaust hood 150, of which the lid 152 is removable, can be nested, so that during transportation from for instance the manufacturer to the next link in the supply chain, less space will be required. The chosen shape also offers advantages for the manufacturing process, because of its shape which is self-releasing in moulding processes.

Another special feature of the discharge structure of FIG. 2 is shown in FIG. 2A. Especially when the combustion gas exhaust hood is made of another material than the air supply hood 140, for instance when the former is made of injection aluminium and the latter is made of a synthetic material, it can be desirable to install a temperature buffer in the shape of a ring 200 which is concentrical to the centre line of the discharge structure and is made from, for instance, PBT synthetic, which has a high temperature resistance.

When temperature causes no problems regarding the connection of the types of material for combustion gas exhaust hood and air supply hood, the ring zoo can also be applied as a optional component on the previously mentioned short circuit between the passage from the outside to the annular line and the ambient air to vent the surplus of air, if desired. For this purpose, the ring 200 is provided with depending projections 202 which are spaced from each other in circumferential direction, and between them leave clear radial passages 203, through which a surplus of air can flow from within the air supply hood towards the outside, around the downwardly extending ring 157.

It will be clear that in FIGS. 1 and 2, corresponding parts have similar reference numerals, increased by 100 for FIG. 2.

Figure 3B:
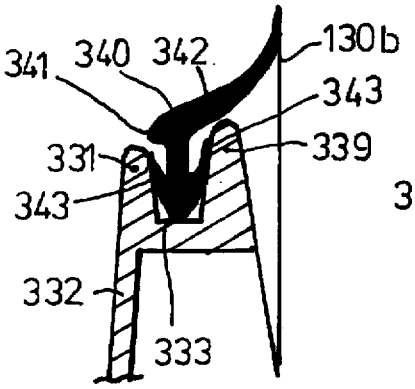
FIG. 3B a detail of the connection of the manifold of FIG. 3 to a discharge structure.
Figure 3:
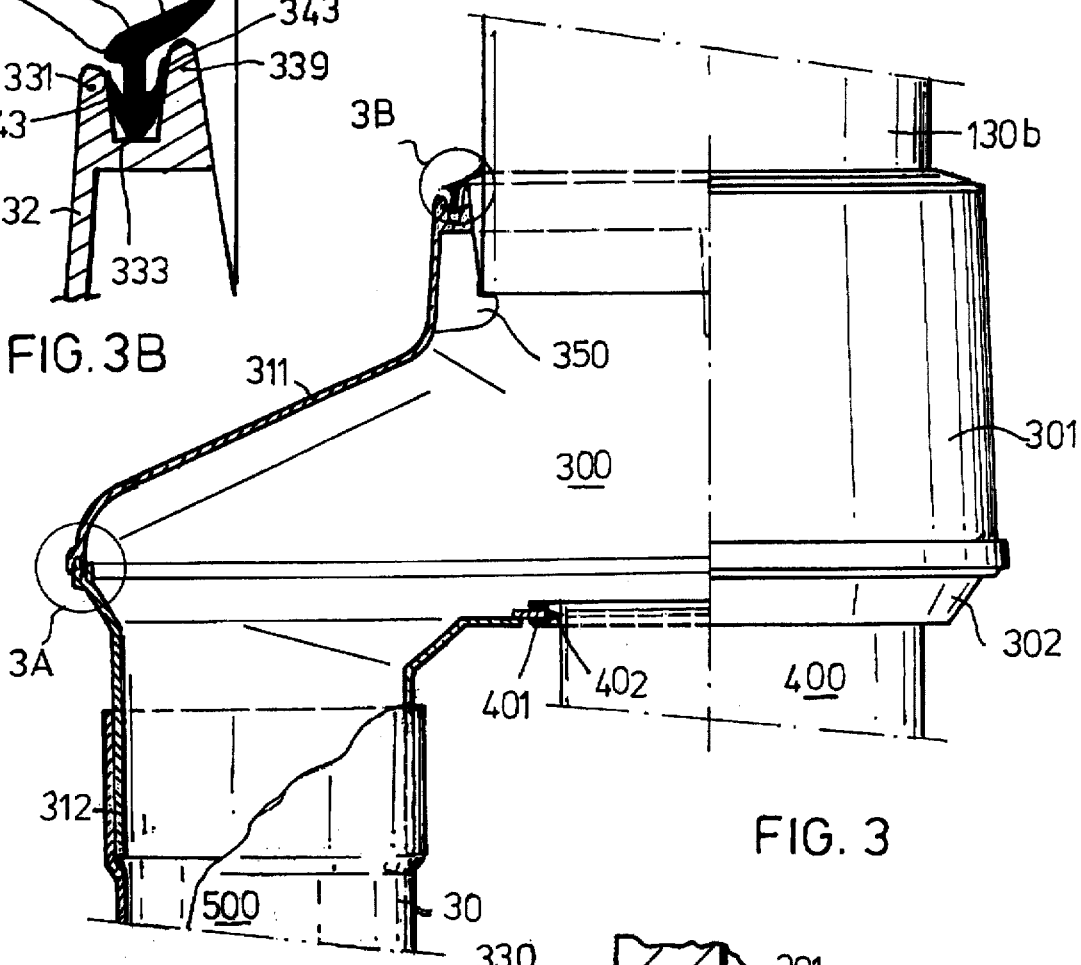
FIG. 3 a manifold for application in, i.a., the discharge structures of FIGS. 1 and 2.

In FIG. 3, the manifold according to the invention has been shown, manufactured from a material suitable for injection moulding and which is injection moulded in two parts through upper part 301 and lower part 302. The manifold 300 has been functionally realized in accordance with usual manifolds, which provide the transition from the concentric arrangement of combustion air supply pipe and combustion gas exhaust pipe to a parallel arrangement for both pipes. At the upper end or, if preferred, the outer end, the manifold 300 connects onto the casing **130*b* and at the lower end or, if preferred, the inner end, the manifold connects onto air supply pipe 500 and gas exhaust pipe 400** for the closed gas appliance, which is not shown.

Figure 3A:
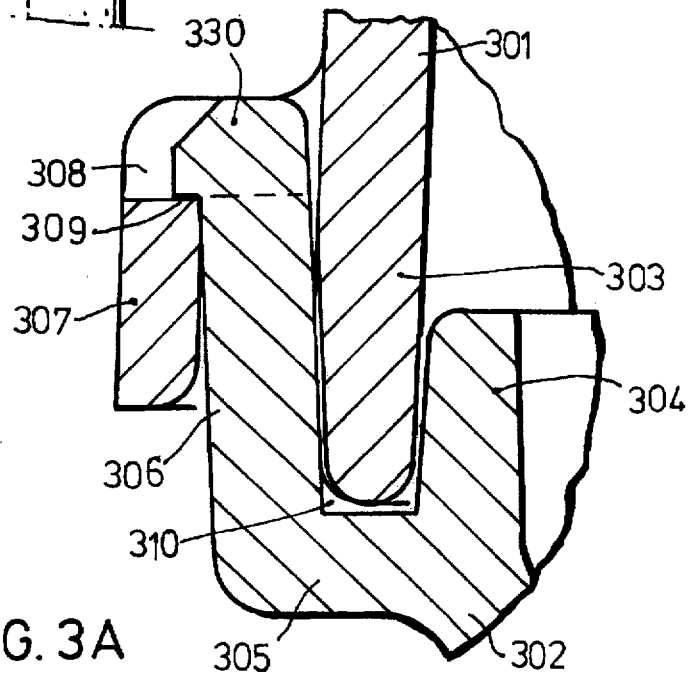
FIG. 3A a detail of the connection of two parts of the manifold of FIG. 3.

The upper part 301 comprises a casing 311 and the lower part 302 comprises a casing 312. Figure 3A shows the connection between both parts. On the upper circumferential edge, the lower part 302 is formed with a U-slot 310, formed by an inner rained roundgoing edge 304 and an outer raised edge 306 projecting above that. This outer edge 306 is provided at regular intervals with projections 330 which are each provided at the radial outer end with a shoulder 309. On the lower edge, the upper part 301 is provided with a roundgoing, downwardly projecting edge 303, and on the radial outer side thereof, via radially projecting bodies 308 arranged at regular intervals, provided with a roundgoing ring 307. What is special now is that the outer ends 330 of the outer, discontinuously roundgoing edge 306 are inserted into the gap between the ring 307 and the edge 303, until the shoulders 309 of the projections 330 come to nest on the upper surface of the ring 307 and snap behind it. Because of the discontinuous realization of the edge 306, the parts thereof can deform sufficiently to allow for the snap movement. At the same time, the edge 303 is accommodated in the U-slot 310, and in such a manner that a labyrinth-shaped closing way is formed and no appreciable leakage can occur via the connecting area between the upper part 301 and the lower part 302. Should this be necessary, however, a plastic sealing means can simply be provided in the U-slot 310.

The shown manifold 300, with its two parts 301 and 302 and its connecting areas, can be formed in a simple manner by injection moulding, wherein it is advantageous that, at the location of the connections with the various connecting pipes, no joint surface is present, so that at that location special provisions will not be necessary for sealing.

Another special feature of the manifold 300 is shown in FIG. 3B. At the outer end of the upper end of the manifold part 301, a circumferential slot 333 is defined by radially inner circumferential edge 339 and radially outer circumferential edge 331, into which circumferential slot a rubber soaring ring 340 fits. This rubber sealing ring 340 has a downwardly projecting body 341, provided on both sides with slopingly upwardly extending, tapering shoulders 343 which are roundgoing. The ring 340 moreover has an inwardly projecting flange or lip 342. The dimensions of this flange 342 are such that they can sealingly come to rest against the outer surface of the casing **130*b*. This casing 130*b* thereby rests with its lower edge against shoulders 350** placed at regular intervals on the circumference (see FIG. 3).

This upper edge of the manifold part 301 is also formed such that it can simply be formed by means of injection mounding. The ring 340 can be placed in the slot in a very simple and controllable manner and will be held securely due to the engagement of the tapering shoulders 343 with the wall surfaces of the slot 333. Until now, this action was more complicated, because at that location use was also made of a flat collar 401 (see FIG. 3), onto which a roundgoing ring 402 had to be placed, which ring was provided wits a radially outwardly directed slot. As a consequence of difference in circumference, placement of such a ring until now required a great deal of time and effort.

I claim:

1. A discharge structure for closed gas appliances, the discharge structure having an inner end and an outer end, comprising:

an outer tubular casing having an outer end and an inner end;

an inner pipe for the exhaust of combustion gases having an outer end and an inner end, the inner pipe being inside the casing to define an annular supply line for combustion air therewith;

a combustion air supply means forming a connection between the ambient air and the annular supply line near the outer end of the outer tubular casing;

a combustion gas exhaust means forming a connection between the ambient air and the inner pipe near the outer end of the inner pipe but further from the inner end of the inner pipe than the combustion air supply means; and retaining means for axially keeping together in a mechanical manner the casing, the inner pipe, the combustion gas exhaust means and the combustion air supply means, the retaining means comprising a first abutment means on the outer end of the inner pipe for acting in a direction toward the inner end of the inner pipe.

2. Discharge structure according to claim 1, wherein the retaining means are arranged for detachably keeping together at least the casing, the gas exhaust pipe and the combustion air supply means.

3. Discharge structure according to claim 1, wherein the retaining means comprises an adjustable retaining portion on the inner end of the inner pipe and engaging the inner end of the casing and a retaining portion on the outer end of the inner pipe, the retaining portions cooperating in series to stay the combustion gas exhaust means, the combustion air supply means and the casing.

4. Discharge structure according to claim 1, the first abutment means being arranged for detaining the combustion gas exhaust means in outward direction, the combustion gas exhaust mean or the gas exhaust pipe being provided with second abutment means for detaining the combustion air supply means in outward direction, the combustion air supply means being provided with third abutment means for detaining the casing in outward direction, and the discharge structure further comprising inner abutment means, which can be secured at a chosen location on the gas exhaust pipe on which form the adjustable retaining portion for detaining the casing in inward direction.

5. Discharge structure according to claim 4, the combustion gas exhaust means comprising a hood, consisting of a first part, slidable over the gas exhaust pipe, from the inside towards the outside, up to against the first abutment means and preferably consisting of a second part, mountable on the first part and comprising a shield member which can be placed in front of the external discharge of the gas exhaust pipe.

6. Discharge structure according to claim 4, the first and the inner abutment means being provided with means for keeping the gas exhaust pipe and the casing and, if present, the insulating sleeve, concentrical relative to each other.

7. Discharge structure according to claim 5, the combustion gas exhaust hood being formed taperingly from the inner end towards the outer end.

8. Discharge structure according to claim 7, the combustion gas exhaust hood being formed taperingly on both the internal and the external side thereof.

9. Discharge structure according to claim 1, the combustion gas exhaust means being integrally formed onto the gas exhaust pipe and the first abutment means being arranged to detain the combustion air supply means in outward direction, the combustion air supply means being provided with second abutment means to detain the casing in outward direction and the discharge structure further comprising inner abutment means, which can be secured at a chosen location on the gas exhaust pipe and which form the adjustable retaining portion for detaining the casing in inward direction.

10. Discharge structure according to claim 1, the inner abutment means comprising a retaining part and a clamping part, which are consecutively slidable from the inner end onto the gas exhaust pipe, the clamping part being provided with securing means, such as a sharp-tipped screw, for securing on the gas exhaust pipe against sliding back.

11. Discharge structure according to claim 10, the clamping part comprising a ring which is slidable onto the gas exhaust pipe.

12. Discharge structure according claim 1, an insulating sleeve being placed in the annular line, which reaches to at least near the outer end of the combustion air supply means and is detained directly or indirectly on its outer end in outward direction by the first abutment means, the gas exhaust pipe or the combustion gas exhaust means and which is detained on the inner end in inward direction by the inner abutment means.

13. Discharge structure according to claim 1, one or more of the said parts being made of synthetic material.

14. Discharge structure according to claim 13, the combustion gas exhaust means being manufactured from a high-temperature-resistant synthetic, such as PBT-synthetic.

15. Discharge structure according to claim 13, when depending on claim 4, the combustion gas exhaust means being manufactured from a injection moulding aluminium and the combustion air supply means being manufactured from a synthetic material, an intermediate ring of a high-temperature-resistant synthetic, such as PBT, being placed between these two.

16. Discharge structure according to claim 1, the casing being composed of at least two parts, a casing part forming the portion of the casing situated outside the roof or wall.

17. Discharge structure according to claim 16, the one casing part being provided with means, such as a storm collar, for receiving roof covering parts, such as the edge of an adhering plate.

18. Discharge structure according to claim 1, the combustion air supply means forming a main passage extending between the ambient air and the annular line, and also being provided with a venting passage, which forms a short circuit between the main passage and the ambient air.

19. Discharge structure according to claim 18, the combustion air supply means comprising a hood, which on its inner end reaches over the outer end of the casing and defines an entrance of the main passage therewith, a venting passage being provided in the outer end of the hood, especially in the shape of one or more holes, for surplus air of the main passage venting to the ambient air.

20. Discharge structure according to claim 19, the combustion gas exhaust means comprising a hood, of which the inner end is provided with a rain and wind screen for screening the opening of the venting passage in the combustion air supply hood.

21. Discharge structure according to claim 19, the outer end of the combustion air supply hood being provided with a rain or wind screen for screening the opening of the venting passage in the air supply hood.

22. Discharge structure according to claim 19, executed as vertical roof terminal structure.

23. Discharge structure according to claim 1, wherein the first abutment means is a radially outwardly projecting shoulder integrally formed on the outer end of the inner pipe.

24. In a combination of a discharge structure for a closed gas appliance having a gas exhaust pipe and a manifold connected with the discharge structure and the gas exhaust pipe, the improvement of the manifold wherein the manifold comprises upper and lower parts having joint faces for arrangement substantially transverse to the gas exhaust pipe and connection means on the upper and lower parts for snap connection of the upper and lower parts, the joint faces cooperating with each other when the upper and lower parts are snap connected as a labyrinth-shaped closing.

25. The combination according to claim 24, wherein the upper and lower parts are injection molded.

26. In a combination of a discharge structure for a closed gas appliance and a manifold, the discharge structure having an outer wall for receipt in one end of the manifold, the improvement wherein the one end comprises concentric edges defining an annular slot open at the one end, and further comprising a sealing ring for going in the annular slot, the sealing ring having a lip that extends radially inwardly when the sealing ring is in the annular slot for sealingly engaging the outer wall, and an essentially round-going body for fitting in the annular slot when the sealing ring is in the annular slot so as to retain the sealing ring therein.

27. The combination according to claim 26, wherein the sealing ring further comprises projections for cooperating with walls that define the annular slot to retain the sealing ring therein.

28. The combination according to claim 26, wherein the sealing ring is rubber-like material.

* * * * *